US005341580A

United States Patent [19]

Teal

[11] Patent Number: 5,341,580

[45] Date of Patent: Aug. 30, 1994

[54] METHOD FOR DRYING WOOD STRANDS

[76] Inventor: William B. Teal, 18902 92nd Ave. West, Edmonds, Wash. 98020

[21] Appl. No.: 7,603

[22] Filed: Jan. 22, 1993

[51] Int. Cl.[5] ..... F26B 3/00

[52] U.S. Cl. ..... 34/446; 34/447; 34/484; 34/500; 34/561; 34/164; 34/210; 34/218

[58] Field of Search ..... 34/218, 25, 26, 28, 34/29, 30, 31, 46, 48, 52, 35, 86, 203, 209, 210, 164, 659, 446, 447, 452, 481, 482, 483, 484, 485, 487, 491, 493, 500, 535, 537, 549, 557, 560, 565, 561

[56] References Cited

U.S. PATENT DOCUMENTS

| | | | |
|---|---|---|---|
| 847,038 | 3/1907 | Ayres | 34/218 |
| 3,299,533 | 1/1967 | Morris | 34/205 |
| 3,996,032 | 12/1976 | McWilliams et al. | 34/164 |
| 4,094,399 | 6/1978 | George | 198/535 |
| 4,753,020 | 6/1988 | Brunner | 34/196 |
| 5,107,602 | 4/1992 | Lööf | 34/1 V |

*Primary Examiner*—Denise L. Gromada
*Attorney, Agent, or Firm*—Seed and Berry

[57] ABSTRACT

A method for drying wood strands and the like is shown and described. In a preferred embodiment, the strands are fed onto a conveyor which then moves the strands as a bed through a dryer housing. The housing may be partitioned into various zones and levels, depending on the desired configuration. A volume of drying air is heated and then passed through the bed of strands to reduce the moisture content of the strands. In a preferred embodiment, the strands are agitated to promote the even exposure of the strands to the drying heat. The strands are then conveyed through a conditioning zone before being discharged from the dryer housing.

21 Claims, 4 Drawing Sheets

METHOD FOR DRYING WOOD STRANDS

TECHNICAL FIELD

This invention relates to a method for drying wood elements, and more particularly, to the drying of wood strands.

BACKGROUND OF THE INVENTION

Oriented strandboard (OSB) is a wood based panel product, the principal component of which is wood strands. The strands are generated by removing the bark from logs and then exposing the logs to an assembly of rotating knives that slice strands from the logs. Because the strands have a high moisture content at this point in the process, they must be dried before they are further processed into the final product. The wet strands are therefore collected and fed into a dryer, after which they are discharged and blended with adhesive. The strands are then oriented by a series of "forming heads" to create a continuous mat of strands. The mat of strands is then separated into discrete lengths which are then compressed and heated to produce panels. The panels are then sawed, sanded, and otherwise processed into the finished product.

The current method of drying strands for OSB production is to feed the wet strands into a rotary dryer. Such dryers tumble the strands while exposing them to a flow of heated air, the inlet temperature of which is typically 800° F. or higher. However, the current method has several disadvantages.

One such disadvantage is the generation and emission of airborne pollutants. Such pollutants include particulate matter entrained in the drying airstream and gaseous pollutants such as carbon monoxide. Although secondary and tertiary cleaning equipment may be used in an attempt to separate particulate and gaseous matter from the airstream prior to its discharge into the atmosphere, such systems are expensive and may still allow a single, typical plant to exhaust hundreds of tons of particulate and gaseous matter into the atmosphere.

Another significant disadvantage of current methods is strand breakage, which occurs due to the tumbling action of the dryer drum, the impact of strands with internal components of the dryer, and the action of rotating airlocks at the dryer infeed and discharge. The broken strands may be either screened out of the process flow or incorporated into the final product. However, if the strands are incorporated into the final product, the quality of the finished board is degraded. Given that a significant quantity of strands processed under current methods break, strand breakage results in a considerable loss industry-wide.

A need therefore exists for a method for drying strands or other similar wood products wherein the occurrence of strand breakage is reduced and the emission of airborne pollutants is reduced.

SUMMARY OF THE INVENTION

It is therefore an object of this invention to provide an improved method for drying wood elements such as strands and the like.

It is another object of this invention to provide a method for drying wood strands and the like that will minimize the occurrence of strand breakage.

It is another object of this invention to provide a method for drying wood strands and the like that will reduce the levels of airborne pollutants emitted to the atmosphere.

These and other objects of the invention, as will be apparent herein, are accomplished by providing a conveyor dryer. In accordance with a preferred embodiment of the present invention illustrated herein, wet wood strands are fed onto a conveyor, thereby forming a loosely compacted bed of strands. The conveyor, which includes means for allowing air to pass through it and therefore through the bed of strands, moves the bed of strands through a dryer housing. By controlling the volume of strands fed onto the conveyor and the speed with which the conveyor moves through the dryer housing, it is possible to control the depth of the bed of strands as well as the retention time, that is, the amount of time the strands are retained in the dryer. To determine the proper retention time several methods may be used, although in a preferred embodiment it is determined by measuring wet-bulb and dry-bulb temperatures of the air exhausted by the dryer and periodically sampling the strands to assess their moisture content.

A volume of drying air or other suitable gas is heated for use in the dryer. Although heating may be accomplished in a variety of ways and may occur either internally or externally to the dryer, in a preferred embodiment, hot air and other gases generated by the combustion of bark and other waste woods are mixed with cooler ambient air to achieve a desired drying air temperature. The heated drying air is then forced or drawn through the bed of strands and circulated around and through the conveyor to dry the strands.

The dryer housing may be partitioned into several zones such that the direction and temperature of the drying air in each zone may be controlled separately. For example, warm air may be forced upward through the bed of strands in a first zone, downward through the bed in a second zone and then upward again in a third zone, the temperature in each zone gradually decreasing. The direction of the air is accomplished in an embodiment illustrated herein by positioning and regulating fans and dampers. In a preferred embodiment, a volume of the heating air is recycled, thereby more efficiently using the thermal energy present in the drying air and thereby reducing the volume of air expelled to the atmosphere as exhaust. In one embodiment, the dried strands are then discharged from the dryer housing. In an alternative embodiment, the dried strands are passed through a conditioning zone before being discharged.

The configuration of the dryer may be altered for particular applications. For example, the conveyor may be configured in a "single pass" whereby the strands are conveyed in a substantially straight line path through the dryer. In an alternative embodiment, the conveyor may be partitioned into sections, each section being positioned at different elevations such that the strands are forced to fall from one conveyor section to the next at a lower elevation. Such a "multi-pass" system occupies less floor space than a single-pass system, and also serves to agitate the strands, thereby promoting even exposure to the drying air. Agitation in either a single- or multi-pass configuration may also be accomplished by exposing the strands to a rotating shaft having radiating spokes or using any other suitable turnover device.

DETAILED DESCRIPTION OF THE INVENTION

Oriented strandboard (OSB) is composed of wood strands that are sliced from logs, dried, coated with adhesive, oriented, pressed, and otherwise formed to create a finished board or panel product. Wood strands for OSB are typically 0.020–0.050 inch thick, 0.25–1.5 inch wide, and 3–12 inches long, although they may be up to 6 inches wide and 15 inches long at a maximum. Under current methods, strands are dried in a rotary dryer. However, there are several disadvantages to this method, including strand breakage and the generation and emission of a high volume of pollutants. These problems, among others, are reduced by drying strands and the like in accordance with the present invention.

Figure 1:
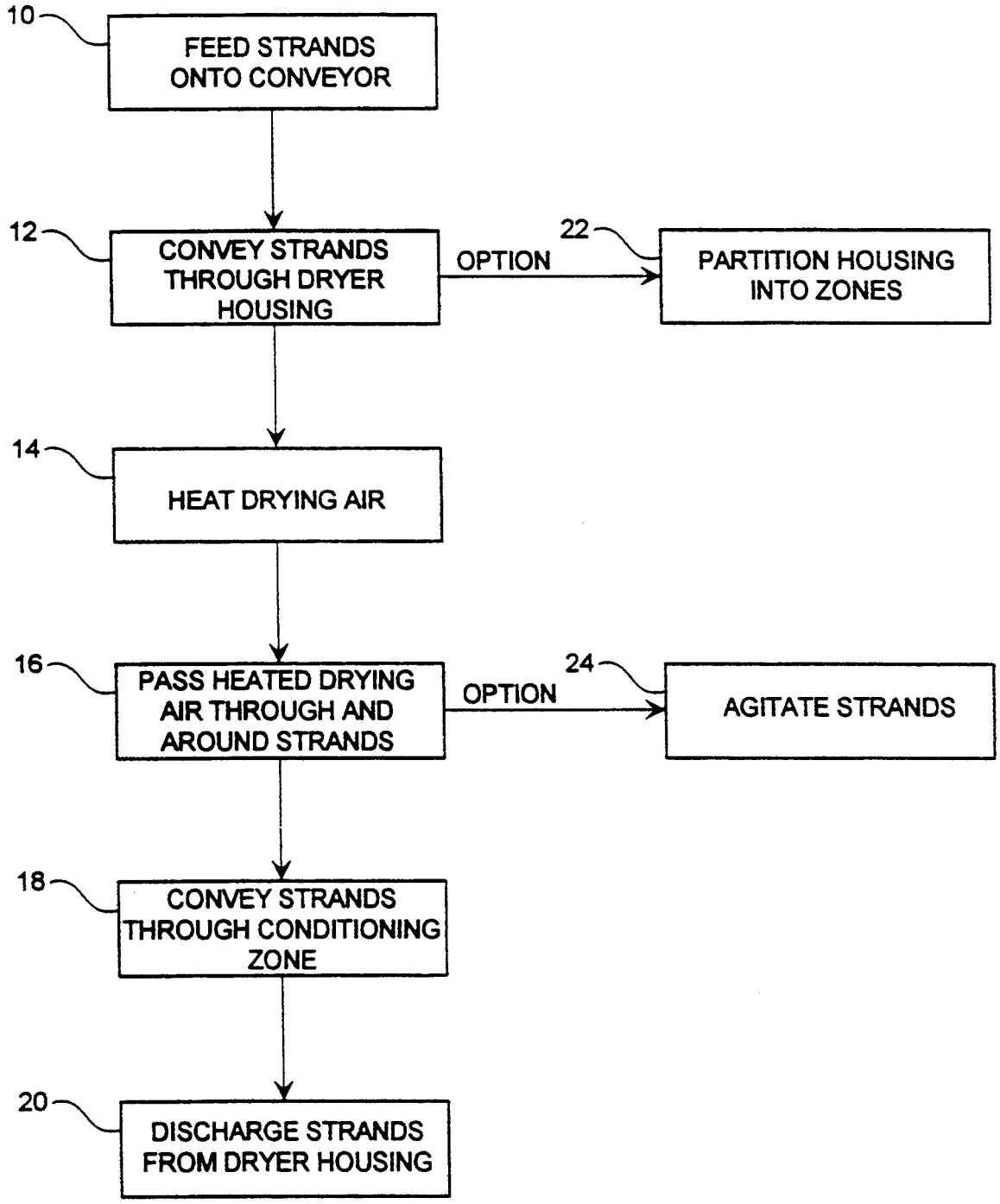
FIG. 1 is a flow chart illustrating the steps of a preferred embodiment of the present invention.
Figure 2:
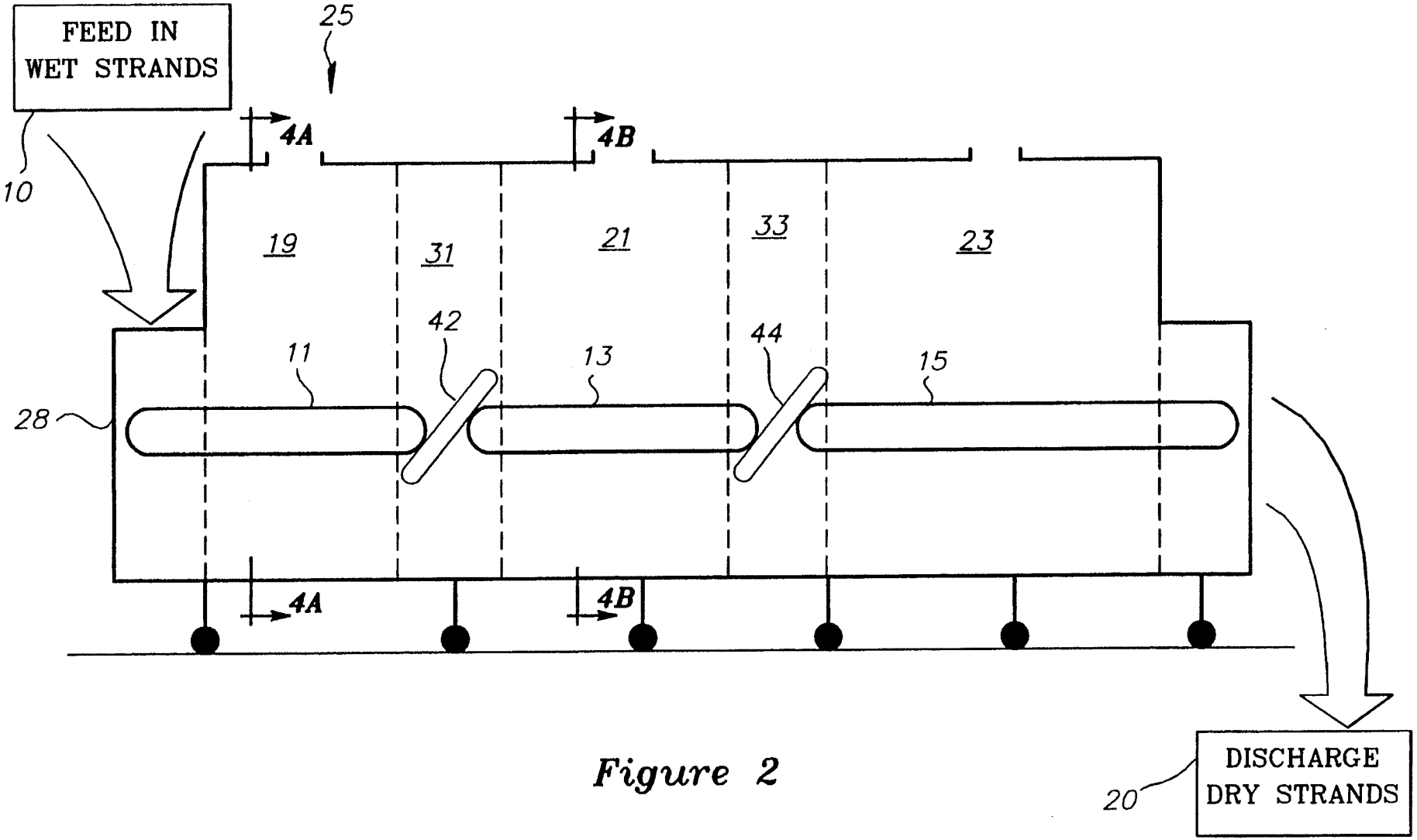
FIG. 2 is a diagram illustrating a dryer in accordance with a preferred embodiment of the present invention.
Figure 3:
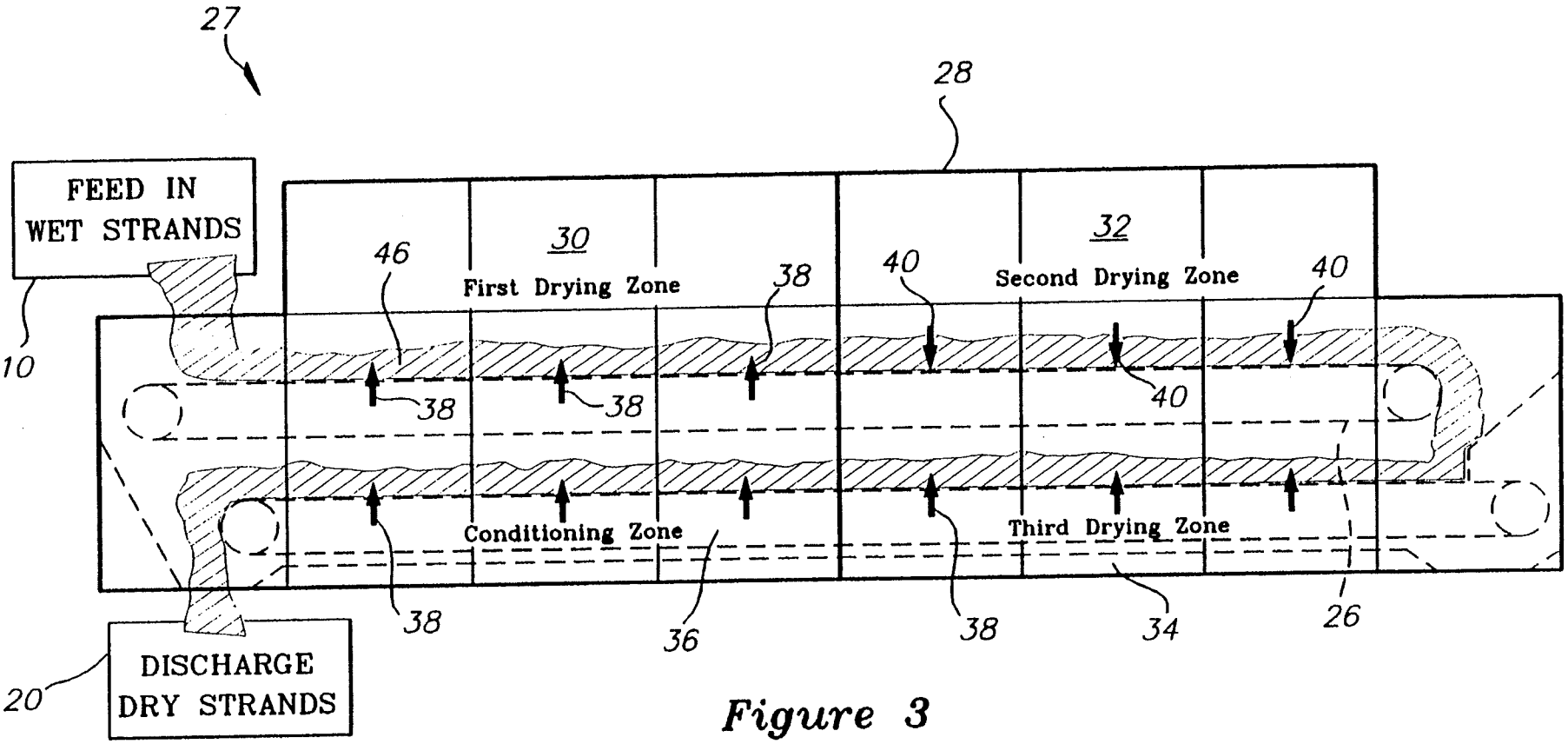
FIG. 3 is a diagram illustrating a dryer in accordance with an alternative embodiment of the present invention.

FIG. 1 illustrates the steps comprising a preferred embodiment of the present invention, whereby strands are dried in a conveyor dryer. Commercially available conveyor dryers such as those manufactured by Aeroglide Corporation are suitable for strand drying in accordance with the present invention. As illustrated in FIGS. 1–3, the strands are fed onto a conveyor 26 or 11, step 10. Although this may be accomplished by a variety of means, in a preferred embodiment, the strands are fed onto the conveyor by an oscillating belt (not shown). The strands are conveyed through a dryer housing 28, step 12, and will follow different paths depending on the configuration of the system. A single pass configuration 25 is illustrated in FIG. 2, wherein the strands are conveyed through the dryer housing 28 in a straight line path. An alternative embodiment is illustrated in FIG. 3, wherein a multipass configuration 27 conveys the strands along a first level, after which the strands drop to a second level or section of the conveyor before being discharged from the dryer housing, step 20.

As further illustrated in FIG. 1, a volume of drying air is heated, step 14. Although this may be accomplished in a variety of ways, in a preferred embodiment, bark and other waste wood is burned to generate hot air and gases that are then mixed with cooler air to result in a volume of drying air having a desired temperature. Although the temperature of the drying air may be set at any level in the preferred embodiment illustrated herein, it is set at a temperature between ambient and 600° F.

Figure 4B:
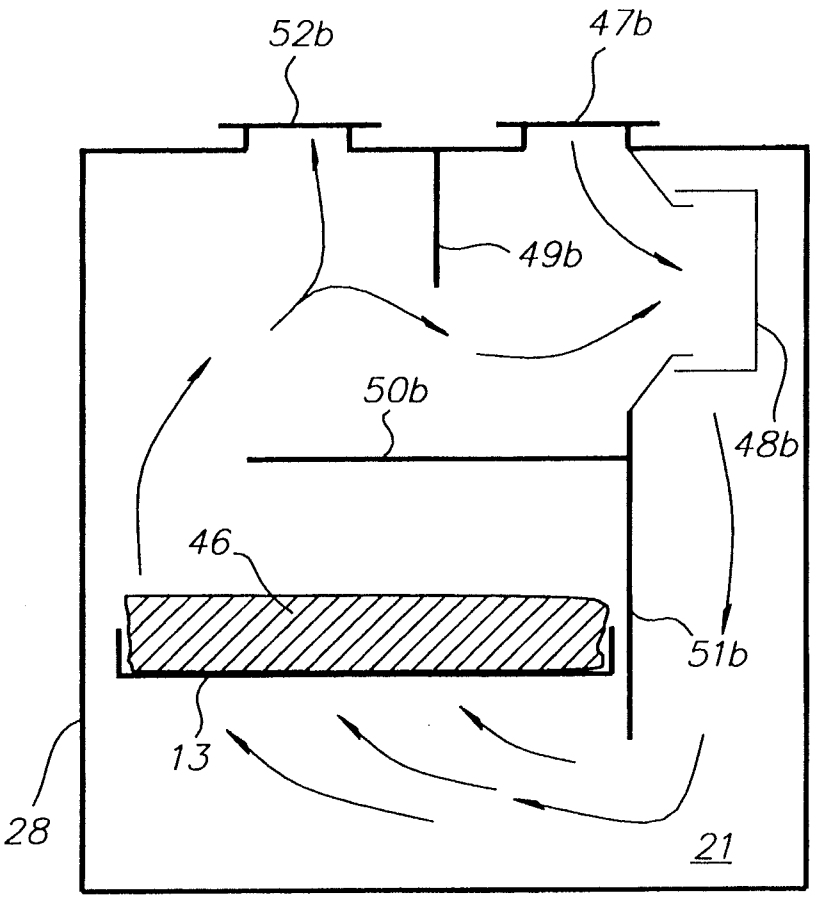
FIG. 4*b* is a sectional end view taken through a zone of the dryer of FIG. 2.
Figure 4A:
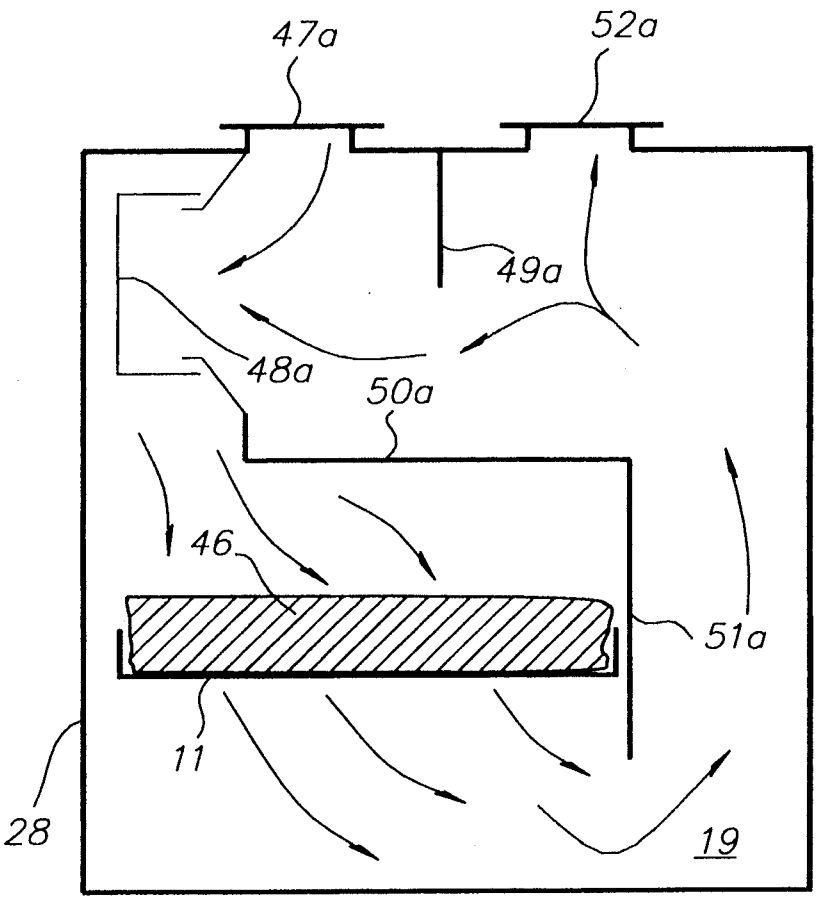
FIG. 4*a* is a sectional end view taken through a zone of the dryer of FIG. 2.

As illustrated in FIG. 3 by arrows 38 and 40, the drying air is passed through the bed of strands, step 16, in either an upward or a downward direction. In a preferred embodiment, the direction of the drying air is controlled by the particular arrangement of fans, partitions and dampers, as illustrated in FIGS. 4*a* and 4*b*. FIG. 4*a* is a sectional end view taken through drying zone 19 of FIG. 2 wherein the drying air is forced downward through the bed of strands 46 on conveyor 11. The relative positioning of intake 47*a*, fan 48*a* and partitions 49*a*, 50*a* and 51*a* serve to direct the airflow. More specifically, a volume of heated drying air is drawn into the drying zone 19 from a supply duct (not shown) at 47*a* by a fan 48*a* which then exhausts the drying air, forcing it down through the bed of strands, thereby evaporating moisture from the strands. As the air circulates around back up towards the top of zone 19, a portion of the moisture-laden air is exhausted at 52*a* while the remainder is drawn back through fan 48*a* along with additional drying air. As a result, a relatively large volume of the drying air is recirculated, thereby making efficient use of the thermal energy in the drying air and minimizing the amount of air that exits the dryer housing 28 as exhaust.

FIG. 4*b* is a cross-sectional end view taken through drying zone 21 of FIG. 2 wherein the drying air is directed upward through the bed of strands 46 on the conveyor 13. The volume of drying air is drawn into zone 21 at 47*b* by fan 48*b* which then exhausts the drying air into a plenum created between the partition 51*b* and the dryer housing 28. The drying air is then forced beneath and up through the conveyor 13 and bed of strands 46, thereby evaporating moisture from the strands. While a portion of the moisture-laden air is exhausted at 52*b*, the remainder is recirculated in a manner similar to the pattern illustrated in FIG. 4*a*. In one embodiment, dampers are used at an entrance 47 and an exit 52 of a drying zone, and between partitions 49 and 50, to further regulate airflow.

As illustrated in FIGS. 2 and 3, the dryer housing may be partitioned into multiple zones, step 22, which zones may be drying zones 19, 21, 23, 30, 32, 34 and/or conditioning zones 36. As illustrated in FIG. 2, the drying zones 19, 21, 23 are separated by buffer zones 31, 33 defined by partitions within the dryer housing 28. The buffer zones allow access to the dryer at various points along the dryer path for inspection and maintenance. In a conditioning zone, step 18, the strands may be either heated or cooled, depending on whether it is desirable for the strands to exit the dryer at a temperature that is higher or lower than the temperature they would be at if they were discharged from the dryer immediately following the completion of the drying process. For example, it may be desirable for the strands to exit the dryer at a relatively high temperature, thereby potentially increasing the thermal efficiency of the pressing process. The strands would therefore be heated in a conditioning zone. The heating or cooling of the strands in a conditioning zone is accomplished in accordance with the present invention by controlling the temperature of the air in the conditioning zone, similar to controlling the temperature of the drying air.

If the dryer housing 28 is partitioned into several zones, as illustrated in FIGS. 2 and 3, the temperature is a given zone may be controlled independently of the other zones. By also controlling the volume of strands fed into the conveyor and the rate with which the conveyor moves through the housing, a depth of a bed of strands and the retention time, or amount of time the strands remain in the housing, may be controlled. As a result, the drying process may be accurately controlled to gradually and evenly dry the strands. In one embodiment, for purposes of illustration, the temperature in first, second, and third drying zones is set to 400° F., 380° F., and 350° F., respectively. A bed of strands is then conveyed through the first zone at 12 ft. per minute, through the second zone at 8 ft. per minute, and through the third zone at 5 ft. per minute. Depending on the length of the various zones, the retention time in each zone will vary. For the system described, however, typical retention times will be on the order of 1–4 minutes in the first zone, 5–10 minutes in the second zone, and 6–16 minutes in the third zone. The required retention time will depend on the moisture content of the wood, which may vary with the species of wood and time of season, among other factors. The moisture content of the wood may be monitored, however, by periodically measuring wet-bulb and dry-bulb temperatures of exhausted drying air, and/or periodically sampling the strands. In this manner, the strands are dried evenly and efficiently.

By drying strands in accordance with the present invention, it is possible to achieve good results at temperatures below 400° F., as opposed to temperatures ranging from 800° F. to 1600° F. in prior art rotary dryers. Because fewer pollutants such as carbon monoxide are produced at lower temperatures, this reduction in operating temperature should significantly reduce the level of pollutants emitted to the atmosphere.

This ability to achieve good results at lower temperatures is due to the fact that unlike prior art rotary dryers, it is possible to accurately control and lengthen the retention time when drying strands in accordance with the present invention. In a rotary dryer, the strands are showered into an entrance of a large, rotating drum. As the drum rotates, the strands are lifted toward the top of the dryer to fall through the drying air stream. The rotational movement of the drum and the motion of the drying airstream advance the strands through the dryer housing. When the strands reach the end of the drum, they fall into a collection bin. Because a minimum quantity of air flow is required to remove the moisture from the system and a minimum speed of rotation of the drum is required to adequately expose the strands to the airstream, it is very difficult to slow down the progression of the strands through the dryer to accurately control the retention time. As a result, if the temperature is reduced in a prior art rotary dryer, the strands are not adequately dried before being discharged. In contrast, the present invention allows complete control of the retention time, such that the temperature may be lowered and the retention time increased sufficiently to adequately dry the strands before discharging them from the dryer.

In addition, by drying strands in accordance with the present invention, the velocity of drying air passing through and around the strands is considerably less than the velocity of air in a rotary dryer, which is believed to also significantly reduce the emission of pollutants by reducing the volume of fines that are entrained in the airstream.

In one embodiment of the present invention, the strands are agitated as they pass through the dryer housing 28, step 24, thereby promoting the even exposure of the strands to the drying air. This agitation may be accomplished in a variety of ways. For example, the strands may be exposed to a rotating shaft having radiating spokes or the strands may be agitated as they fall from one level of the conveyor to a second level of the conveyor, as illustrated in FIG. 3. In an alternative embodiment illustrated in FIG. 2, the strands are conveyed through the dryer housing 28 by three independently driven conveyors 11, 13, 15. At the end of the first drying zone 30, the strands are received by a turnover device 42 comprising an inclined conveyor, which may be independently driven or driven by takeoff from either conveyor 11 or 13. The strands then move upwards and fall from turnover device 42 onto conveyor 13, thereby being agitated. A similar step is repeated between drying sections 21 and 23 by turnover device 44.

If desired, the strands may be conveyed through a conditioning zone, as discussed above, step 18, before being discharged from the dryer housing, step 20.

A method for drying wood strands and the like has been shown and described. From the foregoing, it will be appreciated that, although embodiments of the invention have been described herein for purposes of illustration, numerous modifications may be made without deviating from the spirit and scope of the invention. Thus, the present invention is not limited to the embodiments described herein, but rather is defined by the claims which follow.

I claim:

1. A method for drying wood strands for the manufacture of oriented strand board comprising the steps of:

feeding wood strands onto a belt conveyor to form a bed of strands;

conveying the wood strands on the belt conveyor through a dryer housing in a substantially continuous manner;

heating a quantity of drying air to a desired temperature;

passing the drying air through the bed of strands in the dryer housing; and after passing the drying air through the bed of strands, discharging the wood strands from the dryer housing.

2. The method according to claim 1, further comprising the step of:

controlling the temperature of the drying air as the wood strands move through the dryer housing to regulate a rate of moisture removal from the wood strands.

3. The method according to claim 2 wherein an inlet temperature of the drying air is maintained between ambient and 600° F.

4. The method according to claim 1, further comprising the step of:

burning waste wood to heat the drying air.

5. A method for drying wood strands for the manufacture of oriented strand board comprising the steps of:

feeding a quantity of wood strands onto a belt conveyor provided with means for allowing air to pass through it, to form a bed of strands;

conveying the wood strands on the belt conveyor through a dryer housing in a substantially continuous manner;

passing a volume of heated drying air through the bed of strands; and discharging the wood strands from the dryer housing.

6. The method according to claim 5, further comprising the step of:

oscillating a belt to feed the wood strands onto the belt conveyor.

7. The method according to claim 5, further comprising the step of:

varying a speed with which the belt conveyor moves through the dryer housing thereby controlling a retention time for the wood strands.

8. The method according to claim 7, further comprising the steps of:

measuring wet-bulb and dry-bulb temperatures of drying air exhausted by the dryer; and sampling the wood strands periodically, thereby monitoring the moisture content of the wood strands as they pass through the dryer housing.

9. The method according to claim 5, further comprising the step of:

feeding the wood strands onto the conveyor at a pre-selected rate, thereby controlling a depth of the bed of strands.

10. The method according to claim 5, further comprising the step of:

recirculating a volume of the drying air thereby minimizing a loss of thermal energy.

11. The method according to claim 5, further comprising the step of:

agitating the wood strands as they pass through the dryer housing thereby promoting even exposure to the drying air.

12. The method according to claim 11 wherein the agitation is achieved by exposing the wood strands to a rotating shaft having radiating spokes.

13. The method according to claim 11 wherein the agitation is achieved by dividing the conveyor into different sections having varying elevations and forcing the wood strands to fall from one conveyor section at a first elevation to a second conveyor section at a second, lower elevation.

14. A method for drying wood strands for the manufacture of oriented strand board comprising the steps of:

feeding wood strands onto a belt conveyor to form a bed of strands;

conveying the wood strands on the belt conveyor through a dryer housing in a substantially continuous manner;

heating a quantity of drying air to a desired temperature;

passing the drying air through the bed of strands in the dryer housing;

conveying the wood strands through a conditioning zone; and discharging the wood strands from the dryer housing.

15. The method according to claim 14, further comprising the step of:

varying the speed with which the belt conveyor moves through the dryer housing thereby controlling a retention time for the wood strands in the dryer housing.

16. The method according to claim 14, further comprising the step of:

recirculating a volume of the drying air thereby reducing a loss of thermal energy and a quantity of air that exits the dryer housing as exhaust.

17. The method according to claim 14, further comprising the step of:

agitating the wood strands as they pass through the conveyor housing thereby promoting even exposure to the drying air.

18. A method for drying wood strands for the manufacture of oriented strand board comprising the steps of:

conveying a quantity of wood strands through a dryer housing on a belt conveyor in a substantially continuous manner;

partitioning the dryer housing to create a plurality of zones;

circulating a volume of heated drying air around the wood strands; and discharging the wood strands from the dryer housing.

19. The method according to claim 18, further comprising the steps of:

regulating a direction of flow and a temperature of the drying air; and regulating a speed with which the wood strands move through the plurality of zones thereby encouraging a controlled and gradual drying of the wood strands.

20. The method according to claim 19 wherein the direction of the drying air is controlled by positioning fans and dampers.

21. The method according to claim 18 wherein the dryer housing is partitioned into first, second, and third zones, further comprising the steps of:

setting an inlet temperature of the drying air in the first zone to 400° F.;

conveying the wood strands through the first zone at 12 ft. per minute;

setting an inlet temperature of the drying air in the second zone to 380° F.;

conveying the wood strands through the second zone at 8 ft. per minute;

setting an inlet temperature of the drying air in the third zone to 350° F.; and conveying the wood strands through the third zone at 5 ft. per minute.

* * * * *